US006723961B2

(12) United States Patent
Choat et al.

(10) Patent No.: US 6,723,961 B2
(45) Date of Patent: Apr. 20, 2004

(54) SELF-CLEANING SYSTEM FOR CONVECTION COOKING APPLIANCE

(75) Inventors: Jeffrey T. Choat, Cleveland, TN (US); Timothy M. Pace, Cleveland, TN (US); Robert Z. Whipple, Jr., Louden, TN (US)

(73) Assignee: Maytag Corporation, Newton, IA (US)

( * ) Notice: Subject to any disclaimer, the term of this patent is extended or adjusted under 35 U.S.C. 154(b) by 75 days.

(21) Appl. No.: 10/251,784

(22) Filed: Sep. 23, 2002

(65) Prior Publication Data

US 2003/0015514 A1 Jan. 23, 2003

Related U.S. Application Data

(63) Continuation-in-part of application No. 10/058,323, filed on Jan. 30, 2002, now Pat. No. 6,472,640, which is a continuation-in-part of application No. 09/902,655, filed on Jul. 12, 2001, which is a continuation of application No. 09/650,417, filed on Aug. 29, 2000, now Pat. No. 6,291,808.

(51) Int. Cl.[7] ..... A21B 1/26; F24L 14/02

(52) U.S. Cl. ..... 219/400; 219/413; 219/681; 219/494; 126/21 A

(58) Field of Search ..... 219/400, 412, 219/413, 391, 393, 492, 494, 681, 757; 126/21 A, 21 R

(56) References Cited

U.S. PATENT DOCUMENTS

| | | | |
|---|---|---|---|
| 3,327,094 | A | 6/1967 | Martin et al. |
| 3,353,004 | A | 11/1967 | Alexander |
| 3,521,032 | A | 7/1970 | Heuss |
| 3,819,906 | A | 6/1974 | Gould, Jr. |
| 4,154,861 | A | 5/1979 | Smith |
| 4,197,581 | A | 4/1980 | Watrous et al. |
| 4,327,279 | A | 4/1982 | Guibert |
| 4,397,875 | A | 8/1983 | Gilliom |
| 4,410,779 | A | 10/1983 | Weiss |
| 4,455,478 | A | 6/1984 | Guibert |
| 4,480,164 | A | 10/1984 | Dills |
| 4,481,404 | A | 11/1984 | Thomas et al. |
| 4,493,976 | A | 1/1985 | Wilson |
| 4,503,760 | A | 3/1985 | Pryputsch et al. |
| 4,545,360 | A | 10/1985 | Smith et al. |
| 4,547,642 | A | 10/1985 | Smith |
| 4,555,606 | A | 11/1985 | Thomas et al. |
| 4,654,508 | A | 3/1987 | Logel et al. |
| 4,796,600 | A | 1/1989 | Hurley et al. |
| 4,827,106 | A | 5/1989 | Margraf |
| 4,940,869 | A | 7/1990 | Scholtes et al. |
| 4,954,694 | A | 9/1990 | Nagai et al. |
| 5,066,851 | A | 11/1991 | Darvin |
| 5,089,679 | A | 2/1992 | Eke |
| 5,107,126 | A | 4/1992 | Yano |
| 5,339,726 | A | 8/1994 | Poulson |
| 5,387,258 | A | 2/1995 | Puricelli |
| 5,434,390 | A | 7/1995 | McKee et al. |

(List continued on next page.)

FOREIGN PATENT DOCUMENTS

| | | |
|---|---|---|
| DE | 39 31 482 | 7/1993 |
| JP | 3-144219 | 6/1991 |
| JP | 5-15752 | 6/1993 |

*Primary Examiner*—Philip H. Leung
(74) *Attorney, Agent, or Firm*—Diederiks & Whitelaw, PLC

(57) ABSTRACT

A self-cleaning sequence for a convection cooking appliance employs high velocity air to heat an oven cavity and components/ducting of an air circulation passage to self-cleaning (pyrolitic) temperatures. In accordance with the invention, the self-cleaning sequence includes four stages: a vent catalyst pre-heating stage; a low molecular weight hydrocarbon burn-off stage; a high temperature cleaning stage; and a cool down stage.

20 Claims, 4 Drawing Sheets

U.S. PATENT DOCUMENTS

| | | | | |
|---|---|---|---|---|
| 5,615,603 | A | | 4/1997 | Polin |
| 5,662,029 | A | | 9/1997 | Ubert et al. |
| 5,695,668 | A | | 12/1997 | Boddy |
| 5,717,192 | A | | 2/1998 | Dobie et al. |
| 5,780,815 | A | | 7/1998 | Mestnik et al. |
| 5,927,265 | A | | 7/1999 | McKee et al. |
| 5,994,672 | A | | 11/1999 | Mestnik |
| 6,058,924 | A | | 5/2000 | Pool, III et al. |
| 6,060,701 | A | | 5/2000 | McKee et al. |
| 6,140,626 | A | | 10/2000 | McKee et al. |
| 6,232,584 | B1 | | 5/2001 | Meyer |
| 6,291,808 | B1 | | 9/2001 | Brown |
| 6,316,749 | B1 | | 11/2001 | Bales et al. |
| 6,417,493 | B1 | * | 7/2002 | Bales et al. ..... 219/400 |
| 6,472,640 | B2 | * | 10/2002 | Brown et al. ..... 219/400 |
| 6,573,479 | B2 | * | 6/2003 | Arntz et al. ..... 219/400 |

* cited by examiner

SELF-CLEANING SYSTEM FOR CONVECTION COOKING APPLIANCE

CROSS-REFERENCE TO RELATED APPLICATIONS

The present application represents a continuation-in-part of U.S. patent application Ser. No. 10/058,323 filed Jan. 30, 2002, now U.S. Pat. No. 6,472,640, which is a continuation-in-part of U.S. patent application Ser. No. 09/902,655 filed Jul. 12, 2001, pending, which is a continuation of U.S. patent application Ser. No. 09/650,417 filed Aug. 29, 2000, now U.S. Pat. No. 6,291,808 issued on Sep. 18, 2001.

BACKGROUND OF THE INVENTION

1. Field of the Invention

The present invention pertains to the art of cooking appliances and, more particularly, to a method for self-cleaning a convection cooking appliance.

2. Discussion of the Prior Art

In the art of cooking appliances, it has been heretofore proposed to enable an appliance to operate in a self-cleaning mode. For example, in a conventional range having a cooking cavity which can be heated by one or more cooking elements arranged within the cooking cavity to perform at least baking and broiling functions, it is known to operate one or more of the cooking elements to perform a pyrolytic self-cleaning operation in order to cleanse the walls of the cavity from grease and other food soils developed during normal cooking operations. In such a cooking arrangement, the cooking elements used to perform the cleaning process are located entirely within the cooking cavity.

In addition, it is known to provide a catalytic self-cleaning oven. In such an arrangement, the walls of the oven are coated with a catalytic material which provides for self-cleaning of the oven cavity during cooking operations. In performing any self-cleaning function, byproducts, including smoke, gases and other odorous fumes, are inherently produced. A typical oven cavity will be vented to permit the escape of these byproducts to the ambient surroundings. In some cases, a catalytic oxidation unit is provided in the vent to react with the flowing byproducts.

In still other self-cleaning arrangements, a combination of pyrolytic and catalytic cleaning is performed. Regardless of the fact that various self-cleaning systems have been proposed in the art, there still exists a need for an improved self-cleaning system for a cooking appliance which maximizes the elimination of byproducts, while also minimizing the necessary operating time for the self-cleaning mode. Particular concerns are raised in connection with the necessary operating time and byproduct elimination in a self-cleaning convection oven which essentially relies on a heated flow of recirculating air for raising the temperature in an oven cavity. In any event, there exists a particular need for an improved self-cleaning system for a convection cooking appliance, as well as an improved cleaning method for such a cooking appliance.

SUMMARY OF THE INVENTION

The present invention is directed to a self-cleaning sequence for a convection cooking appliance. The sequence utilizes high velocity air to heat an oven cavity and components/ducting of an air circulation passage to self-cleaning (pyrolitic) temperatures. In accordance with the most preferred embodiment of the invention, the self-cleaning sequence includes four stages: a vent catalyst pre-heating stage; a low molecular weight hydrocarbon bum-off stage; a high temperature cleaning stage; and a cool down stage.

In general, during the vent catalyst pre-heating stage, a door of the oven is locked and an oven vent catalyst is initially heated to facilitate conversion of smoke and various hydrocarbons into carbon dioxide and water. A high output heating element, such as a primary oven cavity heating element, is operated at 100% power. A variable speed blower is operated at a low range to direct a flow of heated air at the catalyst. Heating of the catalyst and, correspondingly, the oven cavity, continues until the catalyst reaches a predetermined temperature, e.g. 450–500° F.

In the next stage, the catalyst is energized to 100% as the blower speed is increased to about 70% of the maximum blower air flow rate. In addition, the primary heating element is heated until the temperature of the catalyst is substantially increased, preferably to about 750° F. Once the oven catalyst reaches the predetermined temperature, this temperature is maintained constant for a predetermined period of time, preferably in the order of 20 minutes.

In the third stage, the blower speed is increased to about 90–100% of the maximum blower air flow rate, and the oven cavity temperature is raised while the catalyst temperature is substantially increased, preferably to a minimum temperature of 900° F. At this point, the oven cavity temperature is maintained for a desired minimum time period, such as 60 minutes. In the overall convection arrangement of the preferred embodiment, the temperature of the oven cavity and the overall air circulation assembly is maintained above about 840° F. The actual duration of this high temperature cleaning stage can be adjusted by the operator in order to improve the overall cleaning process.

In the final stage, a cool down sequence is initiated. During this stage, all of the heating elements are turned off, while the blower is maintained activated. After the oven temperature drops below a prescribed amount, the oven door will unlock, signifying a termination of the self-cleaning operation. Additional objects, features and advantages of the present invention will become readily apparent from the following detailed description of a preferred embodiment thereof, when taken in conjunction with the drawings wherein like reference numerals refer to corresponding parts in the several views.

DETAILED DESCRIPTION OF THE INVENTION

Figure 1:
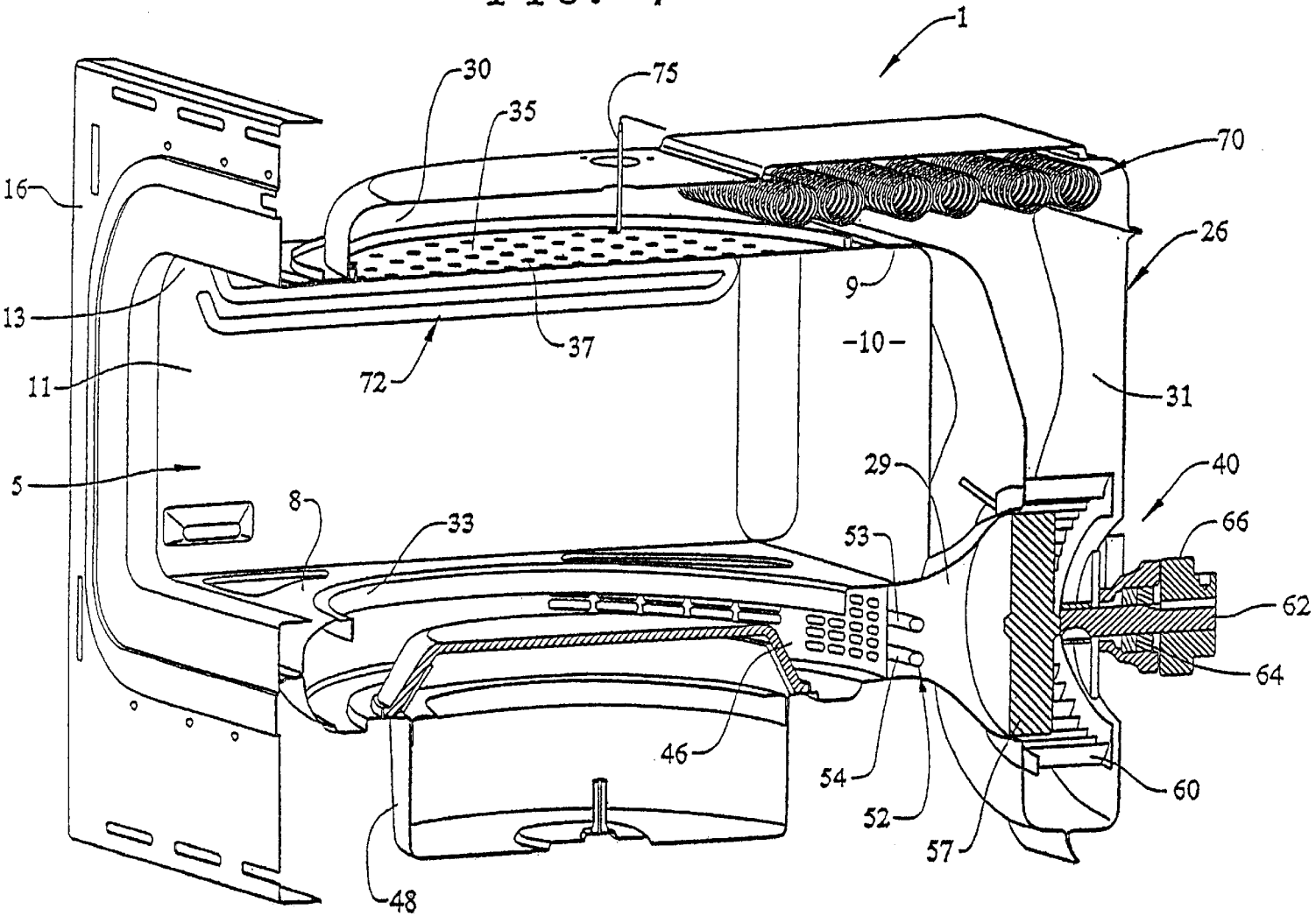
FIG. 1 is a perspective, partial sectional view of a convection cooking appliance constructed in accordance with the present invention.
Figure 2:
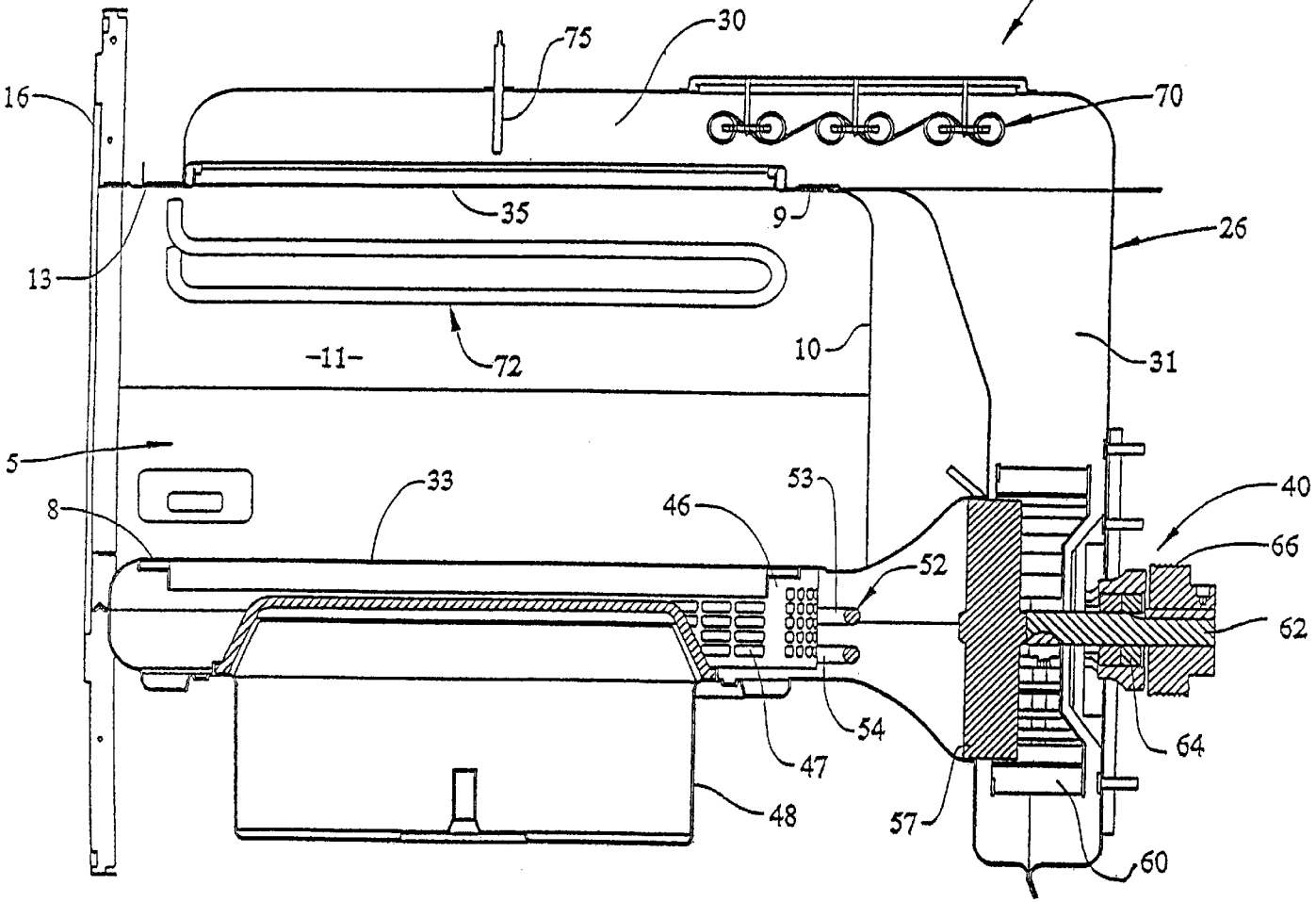
FIG. 2 is a cross-sectional side view of the cooking appliance of FIG. 1.
Figure 3:
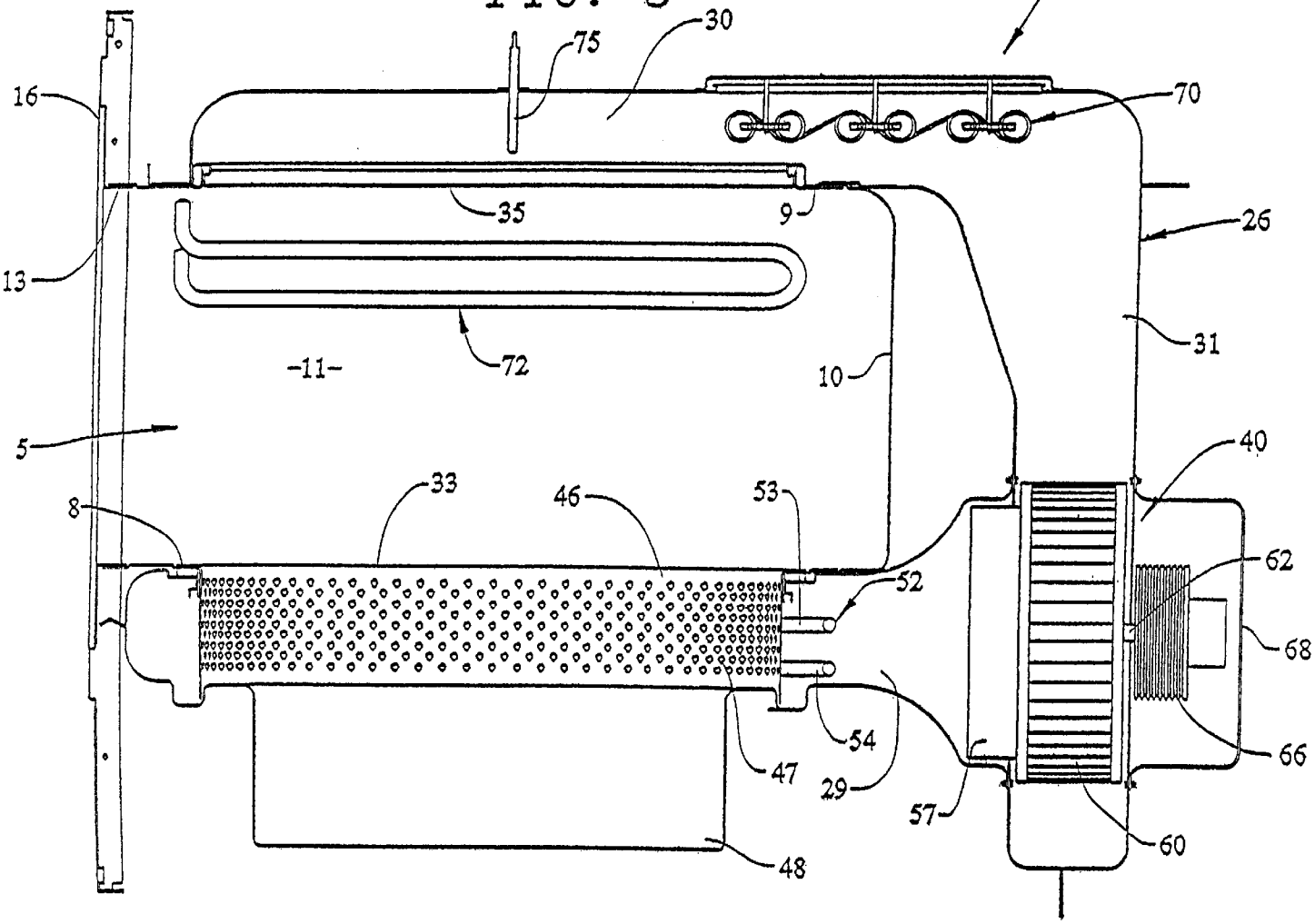
FIG. 3 is a schematic side view, similar to that of FIG. 2, of the cooking appliance.

With initial reference to FIGS. 1–3, a cooking appliance 1 is schematically shown in the form of a wall oven. Appliance 1 includes an oven cavity 5 generally defined by a bottom wall 8, a top wall 9, a rear wall 10 and a pair of side walls, one of which is indicated at 11. Oven cavity 5 also has associated therewith an access opening 13 for food items to be placed into or withdrawn from cavity 5. About access opening 13 is provided a frontal plate 16. In a manner known in the art, frontal plate 16 is adapted to be mounted against a substantially vertical wall such as in the kitchen of a residential home, and would have a door (not shown) pivotally attached thereto for selectively sealing off access opening 13.

Extending generally along top, bottom and rear portions of cavity 5 is an air channel assembly 26 defined by ducting that leads into and out of cavity 5. More specifically, air channel assembly 26 includes a lower air return section 29, an upper air delivery section 30 and a rear air transfer section 31. Lower air return section 29 is open into cavity 5 through a substantially central return air outlet 33 formed in bottom 8. In the most preferred form of the invention, return air outlet 33 is constituted by a generally circular insert provided with various spaced holes (not shown). In a similar manner, upper air delivery section 30 includes a discharge or delivery inlet 35 formed in top wall 9. Although only partially shown in FIG. 1, inlet 35 is also preferably constituted by a generally circular-shaped insert which is attached to the remainder of upper air delivery section 30 and which is provided with a plurality of holes 37.

As will become more fully evident below, the particular construction of cooking appliance 1 can significantly vary in accordance with the present invention. More specifically, it is only important in accordance with the present invention that cooking appliance 1 include an air channel assembly, such as that discussed above with reference to assembly 26, as well as a blower assembly, such as that generally indicated at 40, for use in generating a circulating flow of air through oven cavity 5. In accordance with the present invention, blower assembly 26 constitutes a variable speed unit. Although not considered a part of the present invention, a preferred construction for oven cavity 5 and air channel assembly 26 can be found in U.S. Pat. No. 6,373,037 entitled "OVEN CAVITY CONSTRUCTION" which is hereby incorporated by reference.

In the preferred embodiment shown, cooking appliance 1 constitutes an electric appliance and, more specifically, a combination convection, microwave and radiant cooking device. As shown in this figure, cooking appliance 1 is provided with an annular filter basket 46, having a multitude of circumferentially spaced holes 47, which is positioned within lower air return section 29 and through which the air flowing from cavity 5 through return air outlet 33 is directed. Arranged below filter basket 46 is a microwave generator unit 48 incorporating a magnetron and mode stirrer (both not specifically shown).

Encircling at least a portion of filter basket 46 is a first electric heating element 52. Heating unit 52 is shown as constituted by a sheathed electric resistance heating element having upper and lower interconnected legs 53 and 54. First electric heating unit 52 is preferably provided to heat return air flowing from oven cavity 5, through outlet 33 and filter basket 56 prior to the air reaching a catalyst indicated at 57. In a manner known in the art, catalyst 57 functions to eliminate smoke and the like from the air stream. As shown, catalyst 57 extends partially within a rotatable blower element 60 which forms part of blower assembly 40. Although blower element 60 can take various forms while performing the desired air flow generating function, blower element 60 preferably constitutes a centrifugal unit arranged at the juncture of lower air return section 29 and rear air transfer section 31. In general, blower element 60 is secured to a shaft member 62 that is rotatably mounted through a bearing assembly 64. Shaft member 62 also has attached thereto, for non-relative rotation, a sheave 66 which is adapted to receive a belt (not shown) for use in rotating blower element 60 through shaft member 62 in combination with a variable speed electric motor (also not shown). As illustrated, sheave 66 is preferably arranged within a housing extension 68 which projects from rear air transfer section 31.

Preferably mounted in upper air delivery section 30 adjacent rear transfer section 31 is a second electric heating element arrangement 70 that is preferably constituted by a bank of open heating coils. Most preferably, second heating unit 70 is defined by a single open electric coil arranged in multiple rows, with each row running back and forth across essentially the entire width of upper air delivery section 30 so as to be substantially perpendicular to the direction of flow through upper air delivery section 30. In any event, second heating unit 70 functions to further heat the air flowing through channel assembly 26 prior to the air reaching discharge inlet 35 as will be more fully discussed below. Also shown in this figure is a third electric heating unit 72 which, in a manner similar to first electric heating unit 52, is preferably constituted by a sheathed, resistance-type heating element. Third electric heating unit 72 preferably extends adjacent top wall 9 and constitutes an additional heat source for cavity 5 of cooking appliance 1.

Figure 4:
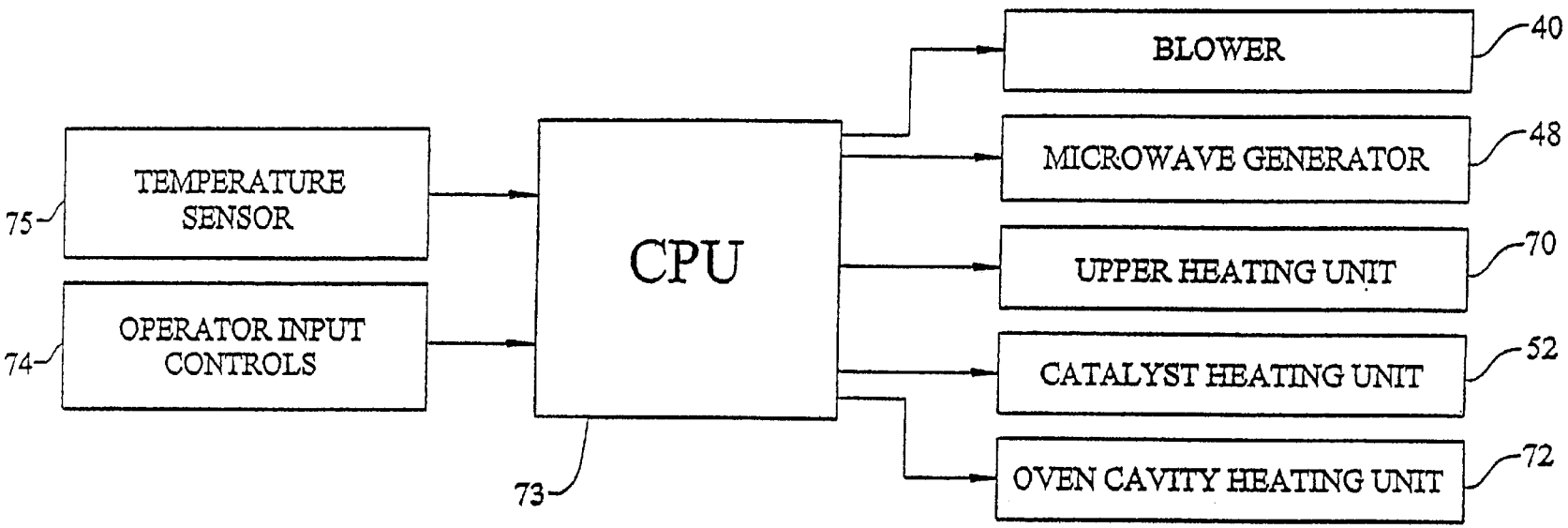
FIG. 4 is a block diagram illustrating a control arrangement used in the convection cooking appliance of the invention.

As represented in FIG. 4, each of blower assembly 40, microwave generator 48 and first, second and third electric heating units 52, 70 and 72 are linked to an appliance controller or CPU 73 and regulated based on established operator settings input at 74, as well as signals received from a temperature sensor 75. The present invention is particularly directed to the manner in which cooking appliance 1 is efficiently and effectively preheated prior to being operated in various modes and between self-cleaning operations. Prior to fully describing the preheat system according to the invention, a general discussion of the operation of cooking appliance 1 will be provided.

First of all, a user of cooking appliance 1 can select, through operator input controls 74, a convection cooking mode wherein heating element 52 is activated, along with blower assembly 40 and heating unit 70, to direct a flow of recirculating air through oven cavity 5. With this arrangement, heated air will be caused to flow within air channel assembly 26 and through holes 37 in order to impinge on food items to be cooked within oven cavity 5. During operation, blower assembly 40 can produce a certain degree of turbulence which is considered detrimental to the uniform and consistent flow of air through channel assembly 26. However, as indicated above, heating unit 70 is preferably constituted by various rows of open coils, with six rows of coils being shown in the preferred embodiment depicted in the drawings. Since the coils are open and arranged perpendicular to the flow of air, any turbulence developed by the operation of blower assembly 40 is transformed into a linear or laminar flow which enhances a smooth and continuous flow through oven cavity 5 for uniform heating.

During a convection cooking mode of operation, heating unit 70 can be cycled on and off by controller 73 in dependence on the temperature of the air as signaled by sensor 75. Within the spirit of the invention, heating unit 70 can also be variably controlled, such as by establishing low, medium or high wattage settings. For purposes of the invention, reference will be made to heating unit 70 and/or heating unit 52 being operable at varying power levels which is intended to encompass various ways in which the heating capacity of each of these units can be altered, e.g. through varying duty cycles and/or wattage settings. Although not shown, heating unit 70 is preferably, electrically linked to controller 73 through the use of a triac. Regardless of the particular operating status of heating unit 70, blower assembly 40 and heating unit 52 are operated continuously throughout the convection cooking mode in accordance with the most preferred embodiment of the invention.

The user of cooking appliance 1 can also select a microwave cooking mode wherein controller 73 activates generator 48. Again, heating unit 52 is preferably, continuously operated whenever cooking appliance 1 is operating in a cooking mode. Furthermore, in a cleaning mode, each of heating units 52, 70 and 72 are controlled for effective high temperature operation as covered by the patent application referenced above.

Upon initial activation of cooking appliance 1 for a convection cooking operation, controller 73 energizes heating unit 70, preferably at full power, and blower assembly 40 is run at a low to moderate speed. Once catalyst 57 reaches a critical temperature, e.g., 450° F., heating unit 52 is initiated under full power, i.e., a high wattage setting and/or 100% duty cycle. At this point, the greases, oils, other hydrocarbons, and the like byproducts remaining from prior cooking operations will begin combusting, thereby generating some smoke, a majority of which is forced out through catalyst 57. Because catalyst 57 has been sufficiently heated, the fats, oils and other hydrocarbons can be completely combusted and converted to carbon dioxide and water with very little or no smoke. As catalyst 57 reaches a critical firing temperature, additional combustion of the grease, oils and other hydrocarbons will commence. Therefore, in this manner, the combustion of the remaining byproducts is performed in various, controlled stages. At this point, the speed of blower assembly 40 is increased to draw additional oxygen into air channel assembly 26 in order to maintain an oxidizing atmosphere.

If a door (not shown) adapted to extend across and substantially seal oven cavity 5 is opened during preheating, blower assembly 40 remains ON in accordance with the invention, but is controlled to operate at a lower speed, preferably in the order of 20%, to create a circulation in oven cavity 5. Blower assembly 40 actually operates to create a negative pressure differential in oven cavity 5 such that any smoke will be drawn back into oven cavity 5 and through catalyst 57, instead of being released into the ambient atmosphere. In addition, the creation of the pressure differential actually functions to draw in more oxygen so as to enable even further combustion.

A main purpose of the preheat system as described above is to clean oven cavity 5 prior to cooking and between self-cleaning operations. The present invention is particularly directed to the self-cleaning sequence employed in connection with oven cavity 5 of convection cooking appliance 1. In general, the self-cleaning sequence of the invention utilizes high velocity air to heat oven cavity 5 and air channel assembly 26 to self-cleaning (pyrolitic) temperatures. In accordance with the most preferred embodiment of the invention, the self-cleaning sequence includes four stages: a vent catalyst pre-heating stage; a low molecular weight hydrocarbon bum-off stage; a high temperature cleaning stage; and a cool down stage, each of which will be detailed fully below.

During the vent catalyst pre-heating stage, the door for oven cavity 5 is locked and catalyst 57 is initially heated to facilitate conversion of smoke and various hydrocarbons into carbon dioxide and water. In accordance with the most preferred form of the invention, heating elements 52 and 70 are operated at 100% power during this stage. At the same time, variable speed blower assembly 40 is operated at a low range, preferably about 20% of maximum speed, to direct a flow of heated air at catalyst 57. Heating of catalyst 57 and, correspondingly, oven cavity 5, continues until catalyst 57 reaches a predetermined temperature, preferably about 500° F.

In the next stage, catalyst 57 is fully energized as heating element 70 is activated until the temperature of the catalyst is substantially increased, preferably to about 750° F. At the same time, the speed of blower assembly 40 is increased to about 70% of the maximum air flow rate. Once catalyst 57 reaches the predetermined temperature, this temperature is maintained constant for a predetermined period of time, preferably in the order of 20 minutes.

In the third stage, the speed of blower assembly 40 is increased to about 90–100% of the maximum blower air flow rate. Heating element 52 is energized at 100% to substantially increase the temperature of catalyst 57, preferably to between 900° F. and 975° F. and, most preferably, to about 930° F. At the same time, heating element 70 and/or heating element 72 is also controlled to raise the temperature of oven cavity 5 and air channel assembly 40 to a minimum temperature above 840° F. This temperature of oven cavity 5 is maintained for a desired minimum time period, preferably at least 60 minutes. However, the actual duration of this high temperature cleaning stage can be adjusted by the operator in order to improve the overall cleaning process.

In the final stage, a cool down sequence is initiated. During this stage, all of heating elements 52, 70 and 72 are turned off, while blower assembly 40 is maintained activated, preferably at about 70% of maximum speed. After the temperature of oven cavity 5 drops below a prescribed limit, preferably set at 500° F., the oven door will unlock. At this point, the self-cleaning operation is terminated.

Although described with respect to a preferred embodiment of the invention, it should be recognized that various changes and/or modifications can be made to the invention without departing from the spirit thereof. For instance, although the present invention has been described with reference for use in connection with cooking appliance 1 which is designed for both convection and microwave cooking, it should be readily apparent that the invention can also be applied to various types of convection cooking appliances, including ranges and other wall oven arrangements not including a microwave source. In particular, it should be realized that the invention is not limited to the inclusion and arrangement of heating elements 52, 70 and 72, so long as the heating functions set forth above are followed. However, it is preferable in accordance with the invention to maintain an in-line heater for the catalyst. In any event, the invention is only intended to be limited by the scope of the following claims.

We claim:

1. A method of performing a self-cleaning operation in a convection cooking appliance including an oven cavity, a vent catalyst, a plurality of heating elements, and a blower for generating a convection air flow through the oven cavity comprising:

initiating a first self-cleaning stage by operating the blower at a first convection air flow speed, while pre-heating the catalyst to a first temperature through the activation of at least one of the plurality of heating elements;

performing a second self-cleaning stage wherein the catalyst is raised to a second temperature, which is greater than the first temperature, and the blower is operated at a second convection air flow speed, which is greater than the first convection air flow speed;

effecting a third, high temperature self-cleaning stage by raising the catalyst to a third temperature which is greater than the second temperature, increasing the blower to a third convection air flow speed, and establishing a minimum oven cavity temperature; and establishing a cooling stage.

2. The method according to claim 1, wherein the blower is operated at approximately 20% of its maximum speed during the first self-cleaning stage.

3. The method according to claim 2, wherein the catalyst is heated to approximately 500° F. prior to proceeding to the second self-cleaning stage.

4. The method according to claim 1, wherein the catalyst is heated to approximately 500° F. prior to proceeding to the second self-cleaning stage.

5. The method according to claim 1, wherein the blower is operated at approximately 70% of its maximum speed during the second self-cleaning stage.

6. The method according to claim 5, wherein the catalyst is heated to approximately 750° F. prior to proceeding to the third self-cleaning stage.

7. The method according to claim 1, further comprising: maintaining the catalyst at the second temperature for a predetermined time period during the second self-cleaning stage prior to proceeding to the third self-cleaning stage.

8. The method according to claim 7, wherein the predetermined time period is established at approximately 20 minutes.

9. The method according to claim 1, wherein the blower is operated at 90% or greater of its maximum speed during the third self-cleaning stage.

10. The method according to claim 1, wherein the third temperature for the catalyst is greater than or equal to 900° F.

11. The method according to claim 10, wherein the third temperature ranges from 900° F. to 975° F.

12. The method according to claim 1, wherein one of the plurality of heating elements constitutes an in-line catalyst heating element, said in-line catalyst heating element being operated at substantially 100% during the third self-cleaning stage.

13. The method according to claim 12, wherein the oven cavity is raised to a cleaning temperature of at least 840° F. during the third self-cleaning stage.

14. The method according to claim 13, further comprising: maintaining the oven cavity at the cleaning temperature for a minimum time period of at least 60 minutes.

15. The method according to claim 14, further comprising: enabling an operator of the cooking appliance to adjust the minimum time period.

16. The method according to claim 1, wherein the blower is operated at approximately 70% of its maximum speed during the cooling stage.

17. The method according to claim 1, further comprising:

maintaining each of the plurality of heating elements de-activated during the cooling stage; and terminating the self-cleaning operation only after the oven cavity exhibits a temperature less than 500° F.

18. The method according to claim 17, wherein the blower is operated at approximately 70% of its maximum speed during the cooling stage.

19. The method according to claim 1, further comprising:

directing the convection air flow through an air channel assembly which extends about at least a portion of and is in fluid communication with the oven cavity; and developing heat by arranging at least one of the plurality of heating elements in the air channel assembly and another one of the plurality of heating elements in the oven cavity.

20. A method of performing a self-cleaning operation in a convection cooking appliance including an oven cavity, a vent catalyst, a plurality of heating elements, and a blower for generating a convection air flow through the oven cavity comprising:

initiating a vent catalyst pre-heating stage with the blower being activated at a small percentage of a maximum blower speed;

performing a low molecular weight hydrocarbon burn-off stage with both the blower speed and a catalyst temperature being increased, wherein the catalyst temperature is maintained for a first predetermined minimum time period;

establishing a high temperature cleaning stage wherein both the blower speed and the catalyst temperature are further increased, and a minimum temperature of the oven cavity is maintained for a second predetermined time period; and effecting a cool down stage, wherein the self-cleaning operation is terminated only after the oven cavity exhibits a temperature reduction below a predetermined level.

* * * * *